US008973314B1

(12) United States Patent
Kurtz

(10) Patent No.: US 8,973,314 B1
(45) Date of Patent: Mar. 10, 2015

(54) STAIRCASE NEWEL SYSTEM AND METHOD OF INSTALLATION

(71) Applicant: L.J. Smith, Inc., Bowerston, OH (US)

(72) Inventor: Craig Allen Kurtz, Canton, OH (US)

(73) Assignee: L.J. Smith, Inc., Bowerston, OH (US)

( * ) Notice: Subject to any disclaimer, the term of this patent is extended or adjusted under 35 U.S.C. 154(b) by 0 days.

(21) Appl. No.: 14/059,886

(22) Filed: Oct. 22, 2013

(51) Int. Cl.
*E04F 11/18* (2006.01)
*E04F 11/02* (2006.01)

(52) U.S. Cl.
CPC ..... *E04F 11/1842* (2013.01); *E04F 11/02* (2013.01)
USPC ..... 52/184; 52/716.1; 52/832

(58) Field of Classification Search
CPC . E04F 11/181; E04F 11/1812; E04F 11/1814; E04F 11/1834; E04F 2011/1868
USPC ..... 52/832, 834, 835, 836, 843, 846, 184, 52/716.1, 716.8, 211, 212, 238.1, 239, 52/780, 745.21, 300, 301, 287.1, 717.01, 52/290, 242, 481.2, 781, 632, 845
See application file for complete search history.

(56) References Cited

U.S. PATENT DOCUMENTS

| | | | | | |
|---|---|---|---|---|---|
| 308,828 | A | * | 12/1884 | Butz | 52/843 |
| 1,409,155 | A | * | 3/1922 | Covan | 52/297 |
| 1,785,025 | A | * | 12/1930 | Felsenthal | 138/171 |
| 1,998,688 | A | * | 4/1935 | Robinson et al. | 52/241 |
| 2,718,382 | A | * | 9/1955 | Bird | 256/19 |
| 3,304,683 | A | * | 2/1967 | Ferreira | 52/764 |
| 3,345,780 | A | * | 10/1967 | McGhee | 49/504 |
| 3,349,532 | A | * | 10/1967 | Dudoff | 52/301 |
| 3,371,454 | A | * | 3/1968 | Anderson | 52/126.4 |
| 3,786,121 | A | * | 1/1974 | Schaerer | 264/45.5 |
| 3,824,747 | A | * | 7/1974 | Zehner, Jr. | 52/239 |
| 4,231,552 | A | * | 11/1980 | Thomas | 256/24 |
| 4,367,864 | A | | 1/1983 | Eldeen | |
| 4,397,127 | A | * | 8/1983 | Mieyal | 52/241 |
| 4,722,514 | A | * | 2/1988 | Pettit | 256/50 |
| 4,949,519 | A | * | 8/1990 | Jeffers | 52/239 |
| 5,526,618 | A | * | 6/1996 | Thomas | 52/211 |
| 5,617,697 | A | * | 4/1997 | Erwin | 52/703 |
| 5,832,675 | A | * | 11/1998 | Zuares | 52/60 |
| 5,862,642 | A | * | 1/1999 | Erwin | 52/834 |
| 6,061,991 | A | * | 5/2000 | Dahl | 52/832 |
| 6,290,212 | B1 | | 9/2001 | Bartel | |
| 6,526,708 | B1 | * | 3/2003 | Hartley et al. | 52/211 |
| 6,568,145 | B2 | | 5/2003 | Bartel | |
| 7,621,080 | B2 | * | 11/2009 | Stanfield | 52/170 |
| 2012/0132878 | A1 | * | 5/2012 | DeCosmo | 256/64 |

FOREIGN PATENT DOCUMENTS

| | | | | |
|---|---|---|---|---|
| EP | 1951969 | | 1/2010 | |
| JP | 54010539 | A * | 1/1979 | E06B 3/88 |

* cited by examiner

*Primary Examiner* — Robert Canfield
(74) *Attorney, Agent, or Firm* — Sand & Sebolt

(57) ABSTRACT

A three-sided newel system and method of installation thereof simulates a four-sided newel post attached to a half wall. Newel system can include a three-sided newel, a base, molding, and a cap. The newel defines a back opening extending from adjacent the top to the bottom of the newel. Back opening is in communication with a cavity defined by the three-sided newel. When the newel system is attached to the half wall, a terminal end of the half wall is disposed within the cavity. Newel system is vertically and longitudinally adjustable relative to the half wall.

20 Claims, 3 Drawing Sheets

STAIRCASE NEWEL SYSTEM AND METHOD OF INSTALLATION

BACKGROUND OF THE INVENTION

1. Technical Field

The present invention relates generally to stairway system components and methods of installation thereof. More particularly, the present invention relates to a newel on a staircase. Specifically, the present invention relates to an adjustable three-sided newel that is configured to receive a half-wall.

2. Background Information

Stairway systems are both functional and decorative aspects of a home. Stairways systems include a set of stairs permitting persons to ascend or descend to different levels of their home. The stairway systems usually including a type of railing that functions as a safety measure to keep a person or items from falling off the edge of a stair.

Stairway railing has evolved over time to become a form of functional art. Wood railings are often handmade or carved by the finest craftsman. These quality railings are highly desired by home owners, yet often the high cost associated with these fine crafted railings prevents home owners from purchasing and installing them. Wood railings often include ornate and hand-carved newels, which serve as a base for the railing banister.

As a cost saving alternative, some homeowners elect to have half-wall partitions or "half walls" installed on staircases in lieu of railings. Half walls often have a wood frame and are usually covered with drywall. Half walls are inexpensive to install and maintain relative to wooden railings yet, still provide the safety measures required for a stairway system. Although half walls may be painted to the home owner's desired aesthetic preference, currently, no newels or newel-like covers or end caps exist for use with half walls.

The present invention addresses this, and other issues.

SUMMARY

In accordance with one embodiment of the present invention a newel system simulates a newel of a staircase attached to a half wall. The newel system provides a home owner with the advantageous ornate and fanciful "newel look and feel" with a cost effective half-wall stair construction technique.

In one aspect, the invention may provide an adjustable newel comprising: a front wall; a left wall and a right wall, each left and right wall extending rearwardly from the front wall; a cavity defined by the front wall, the left wall, and the right wall, and the cavity adapted to receive a half wall of a staircase therein; and an opening defined by and extending from adjacent the top to the bottom of the left and right walls and in communication with the cavity, said opening adapted to receive the half wall therethrough.

In another aspect, the invention may provide an adjustable newel system comprising a newel, wherein said newel includes: a cavity defined by at least three walls mounted together, and generally U-shaped when viewed from above; and a vertically aligned opening defined by at least two of the walls extending from adjacent the top to the bottom of the at least two walls, the opening in communication with the cavity and adapted to receive a wall longitudinally therethrough.

In another aspect, the invention may provide a method of installing a three-sided newel to simulate a four-sided newel attached to a half wall, the method comprising the steps of: providing a three-sided newel defining a rear opening extending from adjacent the top of the newel to the bottom of the newel and defining an inner cavity in communication with the opening; and inserting a terminal end of the half wall through the opening such that the terminal end is disposed within the cavity.

BRIEF DESCRIPTION OF THE SEVERAL VIEWS OF THE DRAWINGS

A sample embodiment of the invention, illustrative of the best mode in which Applicant contemplates applying the principles, is set forth in the following description, is shown in the drawings and is particularly and distinctly pointed out and set forth in the appended claims.

Similar numbers refer to similar parts throughout the drawings.

DETAILED DESCRIPTION

Figure 1:
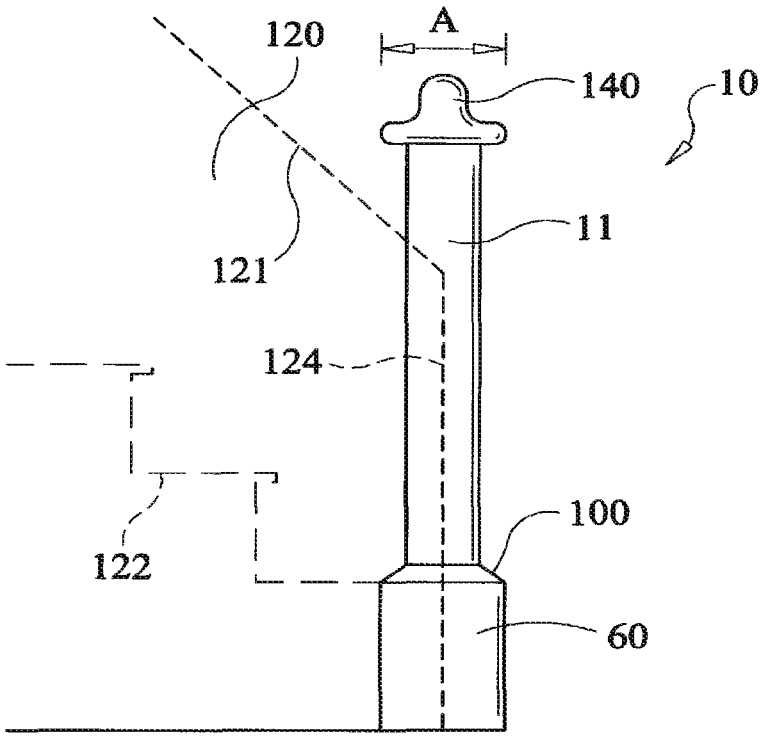
FIG. 1 is an environmental perspective view of a preferred embodiment of the present invention having a newel and a base shown attached to an angled half wall.

As shown throughout FIGS. 1-4D, an adjustable newel system 10 comprises a three sided box newel 11, a base 60 therein receiving the newel 11, molding 100, and a cap 140 connected together and configured to receive a half wall 120 preferably of a staircase 122. Adjustable newel system 10 is adjustable longitudinally as well as vertically.

As shown in FIGS. 3A-3I, newel 11 includes a top 12 and a bottom 14 that therebetween define a vertical direction. Newel 11 includes a front side 16 and a back side 18 that therebetween define a longitudinal direction. Newel 11 has a left side 20 and a right side 22 that therebetween define a lateral direction. Newel 11 further comprises a front wall 24, a left wall 26, a right wall 28, a back wall 30 defining an opening 32 in communication with a cavity 34, and a bottom opening 36.

Figure 3A:
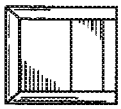
FIG. 3A is a top view of the newel facing leftwardly.
Figure 3C:
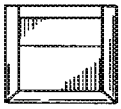
FIG. 3C is a top view of the newel facing rearwardly.
Figure 3E:
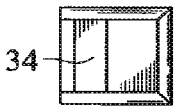
FIG. 3E is a top view of the newel facing rightwardly.
Figure 3G:
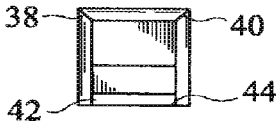
FIG. 3G is a top view of the newel facing rearwardly.
Figure 3B:
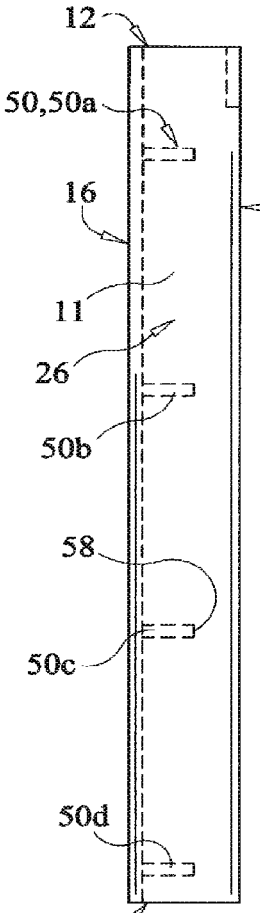
FIG. 3B is an elevation view of the left side of the newel.
Figure 3D:
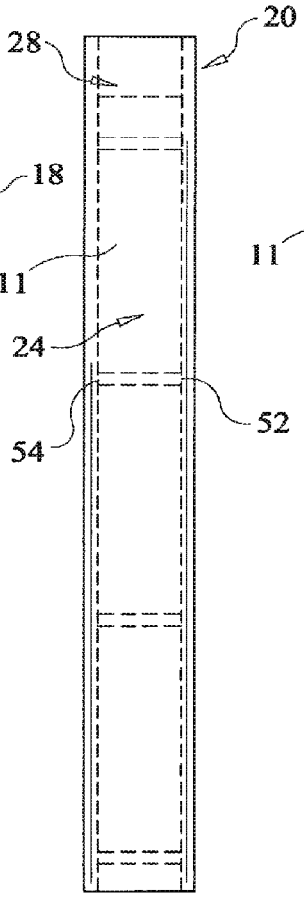
FIG. 3D is an elevation view of the front side of the newel.
Figure 3F:
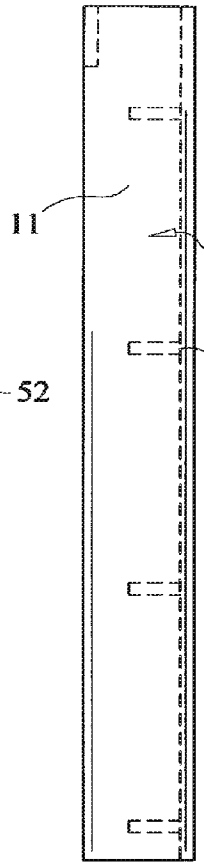
FIG. 3F is an elevation view of the right side of the newel.
Figure 3H:
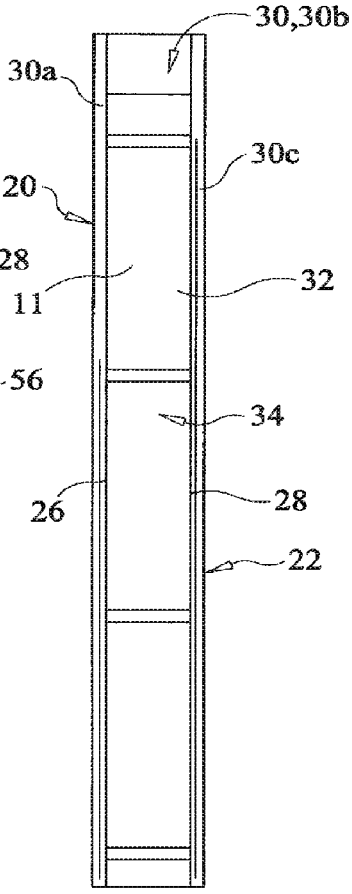
FIG. 3H is an elevation view of the rear side of the newel.

Front wall 24 extends vertically from top 12 to bottom 14 and includes an outwardly and forwardly facing outer surface and an inwardly or rearwardly facing inner surface. Front wall 24 extends laterally from left side 20 to right side 22. Left wall 26 extends vertically from top 12 to bottom 14 and includes a left and outwardly facing outer surface and a right or inwardly facing inner surface. Left wall 26 extends longitudinally from front 16 to back 18. A front edge of left wall 26 connects to a left edge of front wall 24 to form a first or left miter edge joint 38 (FIG. 3G). Right wall 28 extends vertically from top 12 to bottom 14 and includes a right and outwardly facing outer surface and a left or inwardly inner surface. Right wall 28 extends longitudinally from front 16 to back 18. Right wall 28 connects at a forward edge to a right edge of front wall 24 to form a right or second miter edge joint 40 (FIG. 3G).

Back wall 30 includes a left segment 30*a*, a top center segment 30*b* and a right segment 30*c*. Left segment 30*a* is a rearwardly facing surface defined by left wall 26. Right segment 30*c* is a rearwardly facing segment defined by right wall 22. Top center segment 30*b* extends laterally from left 20 to right 22 adjacent top 12. Top center segment 30*b* extends downwardly from top 12 a short distance. In the preferred embodiment, top center segment 30*b* extends downwardly approximately from 2 to approximately 4 or 5 inches. Top center segment 30*b* forms a first butt joint 42 (FIG. 3G) with left wall 26 and a second butt joint 44 (FIG. 3G) with right wall 28. Top center segment 30*b* has a rearwardly and outwardly facing outer surface and a forwardly or inwardly facing inner surface.

Figure 3I:
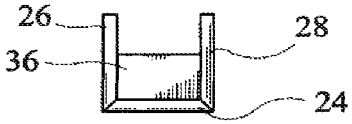
FIG. 3I is a bottom view of the newel.

Back opening 32 is defined by the interior edges of back wall segments 30*a*, 30*b*, and 30*c*. Back opening 32 extends from adjacent top 12 to and through bottom 14. Opening 32 is a through opening in communication with cavity 34. The interior edges defining back opening 32 are an inverted "U-shape" when viewed from the back. Cavity 34 is defined by the inner surfaces of front wall 24, left wall 26, right wall 28 and back wall 30 when walls 24, 26, 28, and 30 are connected together. Opening 32 and cavity 34 are further in communication with the bottom opening 36 (FIG. 3I). Bottom opening 36 is defined by the bottom interior edges of front wall 24, left wall 26 and right wall 28 when walls 24, 26, 28 are connected together.

Newel 11 further includes a plurality of cross members 50. Four cross members, shown as 50*a*, 50*b*, 50*c* and 50*d* are shown spaced apart as vertically aligned and positioned within the cavity 34. In the shown embodiment, cross members 50*a*, 50*b*, 50*c*, 50*d* are shown spaced equidistant from one another, however other vertically aligned spaced configurations, or numerical plurality of cross members 50 within cavity 34 are contemplated. Cross members 50 extend laterally from inner surface of left wall 26 to inner surface of right wall 28 forming cross member left butt joints 52 (FIG. 3D) and cross member right butt joints 54 (FIG. 3D), respectively. Further, cross members 50 form a front butt joint 56 (FIG. 3F) with front wall 24. Cross members 50 include a rear edge 58 (FIG. 3B) positioned longitudinally about halfway into cavity 34. Cross members 50 are longitudinally shorter than left and right walls 26, 28.

With primary reference to FIGS. 4A-4D, newel system 10 further includes a base 60 that receives and is mounted adjacent the bottom 14 of newel 11. Base 60 includes a front wall 62, a base left wall 64, a base right wall 66, a base back left segment 68, a base back right segment 70, a base cavity 72 defined by walls and segments 62, 64, 66, 68, 70, and a base back opening 75 defined by segments 68, 70.

Base front wall 62 has a forwardly and outwardly facing outer surface and a rearwardly or inwardly facing inner surface. Front wall 62 extends vertically from top to bottom and laterally from left side to right side. Front wall 62 is connected to left wall 64 by a miter joint.

Base left wail 64 includes an outward and left facing outer surface and a rightward or inwardly facing inner surface. Base left wall 64 extends vertically from top to bottom and longitudinally from front to back. Base right wall 66 is connected to front wall 62 by a miter joint. Base right wall 66 includes an outwardly and right facing outer surface and an inwardly and left facing inner surface. Base right wall 66 extends vertically from top to bottom and longitudinally from front to back.

Figure 4A:
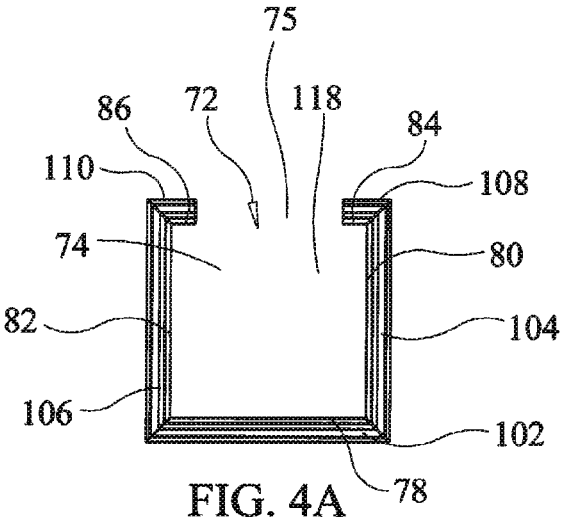
FIG. 4A is a top view of the base of the preferred embodiment having molding.
Figure 4C:
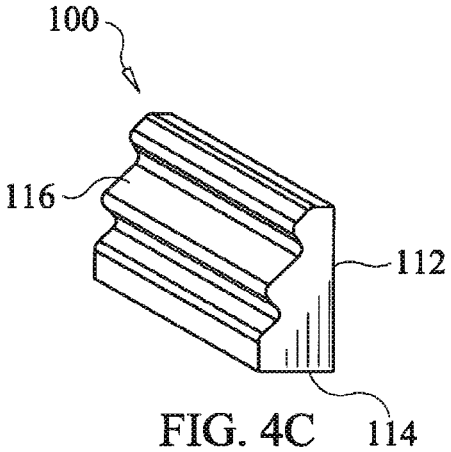
FIG. 4C is a perspective view of the molding.
Figure 4B:
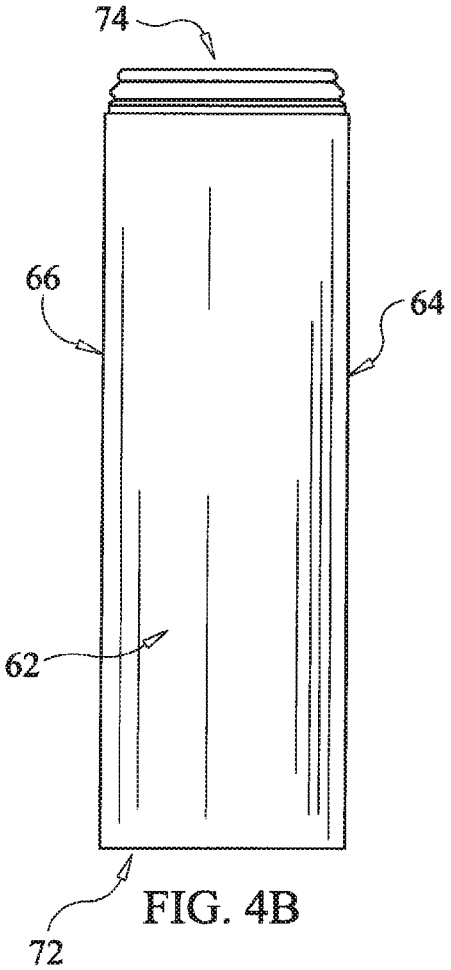
FIG. 4B is an elevation view of the front side of the base.
Figure 4D:
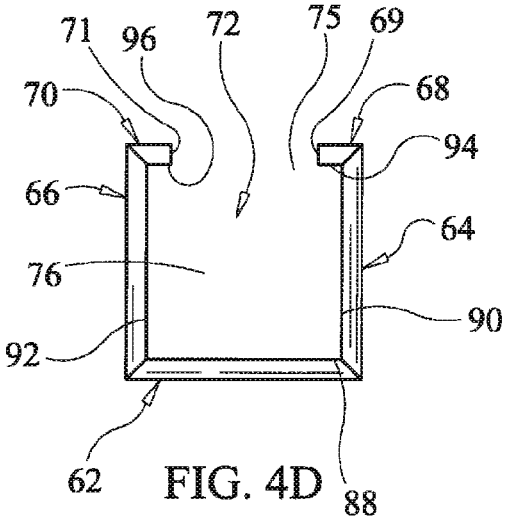
FIG. 4D is a bottom view of the base.

Base back left segment 68 is connected to the rear side of base left wall 64 by a miter joint. Base back left segment 68 extends vertically from top to bottom and only partially from the left side and terminating at a terminal edge 69. Base back left segment 68 includes a rearwardly facing outer surface and an inwardly facing inner surface. Terminal edge 69 of base back left segment 68 faces right wall 66 when viewed from below, as shown in FIG. 4D.

Base back right segment 70 is attached to the rear side of base right wall 66 by a miter joint. Base back right segment 70 extends vertically from top to bottom and extends only partially from the right side towards the left, terminating at a terminal edge 71. Base back right segment 70 includes a rearwardly or outwardly facing outer surface and a forwardly or inwardly facing inner surface. Terminal edge 71 of base back right segment 70 is faces left wall 64, when viewed from below, as shown in FIG. 4D.

Back opening 75 is a through opening extending from outer surface of segments 68, 70 to inner surface of segments 68, 70. Back opening 75 is vertically defined by the terminal edges 69, 71 of base back left segment 68 and base back right segment 70, respectively.

A base top opening 74 is defined by base front top edge 78, left wall top edge 80, right wall top edge 82, left back segment top edge 84 and right back segment top edge 86. A base bottom opening 76 is defined by front wall bottom edge 88, left wall bottom edge 90, right wall bottom edge 92, left back segment bottom edge 94, and right back segment bottom edge 96.

The openings, 74, 75, and 76 are each through openings and in communication with cavity 72. Base cavity 72 is defined by the inner surfaces of front wall 62, left wall 64, right wall 66, left segment 68 and right segment 70 when connected together.

Base 60 receives the bottom end 14 of newel 11. Newel 11 fits within cavity 72. When assembled (FIGS. 1-2), inner surface of base front wall 62 is closely adjacent outer surface of front wall 24 near bottom 14. Inner surface of base left wall 64 is closely adjacent outer surface of left wall near bottom 14. Inner surface of base right wall 66 is closely adjacent outer surface of right wall near bottom 14. Base bottom opening 76 is in communication with bottom opening 36.

With continued reference to FIGS. 4A-4D, system 10 may further include base molding 100. Molding 100 is preferably atop and base 60 around the outer surface of newel 11, yet other mounting locations are clearly possible. Molding 100 includes molding front member 102, molding left member 104, molding right member 106, molding back left member 108 and molding back right member 110. When molding members are assembled, base molding 100 is positioned atop base 60. Molding front member 102 extends laterally from left to right. Molding front member 102 connects to left molding left member 104 via a miter joint and molding front member 102 connects to molding right member 106 via a miter joint. Molding left and right members, 104, 106 extends longitudinally from front to back. Molding back left member 108 connects to molding left member 104 via a miter joint and extends towards the right only partially. Molding back right member connects to the rear side of molding right member 106 and extends leftwardly only partially.

Each molding member comprises a vertical inner surface 112, a horizontal bottom surface 114, and a decorative outer molded surface 116. A molding aperture 118 is defined by the inner surfaces 112 of the respective molding members 102, 104, 106, 108 and 110 when assembled. Molding aperture 118 is superimposed atop top opening 74 and is in communication with cavity 72.

A cap 140 (FIG. 1) may be mounted atop newel 11. Cap 140 may include decorative molding or additional elements ordinarily found atop newels, such as, a volutes, turn caps, gooseneck caps, easing caps, or other known staircase elements configured to set onto the top of the newel.

Once newel 11 is mounted to base 60, it is connected to half wall 120. Half wall 120 includes a forward facing terminal wall 124. Terminal wall 124's width is equal to or slightly smaller than the lateral width of back opening 32 of newel 11 and back opening 75 of base 60. A longitudinal portion 126 of wall 120 extends rearwardly from terminal wall 124. Longitudinal portion 126 is received into cavities 34, 72 through back openings 36, 75. Further, half wall 120 includes a left facing left surface 128 and a right facing right surface 130.

Newel system 10 is longitudinally adjustable along arrow A as seen in FIG. 1. When in a fully engaged or assembled position (FIG. 2), terminal side 124 contacts cross members 50*a*, 50*b*, 50*c*, and 50*d* creating a butt joint at each respective point of contact. Cross members 50*a*, 50*b*, 50*c*, and 50*d* may be secured to terminal wall 124 of half wall 120 in a known manner, such as brackets, screws, or adhesive. When in the fully engaged, mounted, and assembled position, right surface 130 may be attached to inner surface of right wall 28, and left surface 128 may be attached to left wall 26 in a conventional manner, such as glue or screws. Newel system 10 may be adjusted longitudinally forward along directional arrow A in a manner such that a gap is created between terminal wall 124 and connecting members 50*a*, 50*b*, 50*c*, and 50*d* when newel system 10 is in the mounted position.

Figure 2:
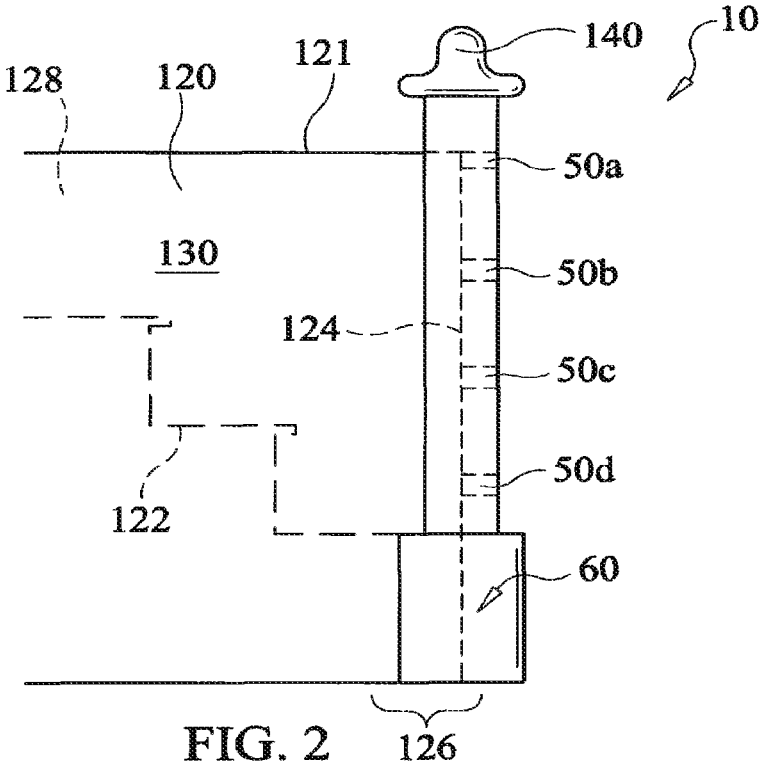
FIG. 2 is an environmental perspective view of the preferred embodiment of the present invention shown attached to a horizontal half wall.

Half wall 120 is included within a staircase system comprising stairs 122. Stairs 122 have a rake, which is the angle or pitch of the stairway ascent to an upper level, established by the rise and run of each stair. The top 121 of half wall 120 may be horizontally parallel relative to the floor as shown in FIG. 2 or the top 121 of half wall 120 may be angled in an ascending or descending manner relatively similar to the rake of stairs 122 as shown in FIG. 1.

In accordance with one embodiment of the present invention as described above, assembled newel system 10 provides a simulated element of a staircase (i.e., a newel) that has not been previously known or attached to a half wall. Newel system 10 provides a home owner with the advantageous ornate and fanciful "newel look and feel" with a cost effective half-wall stair construction technique. Further, newel system 10 is adjustable both longitudinally and vertically. Homeowner or installer may position and mount newel system 10 to half wall 120 in any position such that terminal wall 124 is within cavity 34.

In operation, it is contemplated that newel system 10 is provided fully constructed in a factory and sold directly to a consumer or homeowner in an assembled state. However, clearly, the walls of newel system may be sold unassembled for in situ assembly by a homeowner or hired installer. To install newel system 10 on a staircase having a half wall 120, user should ensure half 120 has been properly finished. As understood in this application, half wall 120 is deemed finished once drywall or gypsum board has been secured to the half wall frame.

Newel system 10 is positioned such that top 12 is facing upwards and bottom is facing downwards. Front wall 24 is facing the same forward direction as front terminal wall 124 of half wall 120. Back opening 32 is aligned with front terminal wall 124. System 10 is moved longitudinally rearward to receive half wall 120 so that terminal wall 124 moves through back opening 32 into cavity 34.

Once terminal wall is disposed within cavity 34, user may adjust system 10 both vertically and longitudinally to meet the owners desired look and feel. System 10 is secured to half wall 120 when in a position satisfactory to the owner. A satisfactory position is one that has terminal wall 124 disposed within cavity 34 and is aesthetically pleasing to the system 10 owner. Further, system 10 may be secured by screws, adhesive or other conventional means understood in the staircase field of art.

Additional non-structurally supportive design elements may be added to newel system 10 to provide a more decorative look and feel. For example, paneling or wainscoting may be mounted to or formed in the outer surface of newel 11 and base 60 walls.

While newel system 10 is constructed primarily in the three wall design as disclosed herein above, it is alternatively contemplated that a four-sided hollow box newel (i.e., one that is ordinarily slid over a post, typically a 4"×4" post) may be altered to create the newel 10 of the present invention by removing or cutting an opening in the rear wall to convert the four-side newel to a three-sided newel to slidably receive a half wall.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the invention are an example and the invention is not limited to the exact details shown or described.

The invention claimed is:

1. An adjustable newel system comprising:

a front wall on a newel;

a left wall and a right wall on the newel, each left and right wall extending rearwardly from the front wall;

a cavity defined by the front wall, the left wall, and the right wall;

a rear opening defined by rear ends of the left and right walls and extending from adjacent the top to the bottom of the left and right walls and in communication with the cavity;

a staircase including a set of stairs having a rake defined by a rise and run of each stair; and a half wall on the staircase including an angled top wall and a generally vertical terminal end;

wherein the half wall extends through the rear opening and the terminal end is disposed within the cavity.

2. The newel system of claim 1, further comprising:

a base having three sides and defining a base opening and a base cavity, wherein the base cavity receives the bottom of the newel therein;

wherein the base opening is vertically aligned with the rear opening so the half wall extends through the base opening such that the terminal end is disposed within the base cavity.

3. The adjustable newel system of claim 1, further comprising:

a rear segment spaced apart from and at equal height with the front wall and extending between the left and right walls and above the rear opening, wherein the rear segment extends downward a length less than the left and right walls, and wherein the rear segment is above the top wall at the opening.

4. The adjustable newel system of claim 1, further comprising:

a upwardly facing top surface on the front wall; and wherein the top wall is angled upwardly relative to the top surface on the front wall.

5. The adjustable newel system of claim 1, wherein the top wall is angled similar to the rake defined by the set of stairs.

6. An adjustable newel system comprising:

a staircase including a set of stairs having a rake defined by a rise and run of each stair;

a half wall on the staircase including a top wall and a generally vertical terminal end;

a newel, wherein said newel includes:

a cavity defined by at least three walls mounted together, and generally U-shaped when viewed from above; and a vertically aligned opening defined by at least two of the walls extending from adjacent the top to the bottom of the at least two walls, the opening in communication with the cavity;

wherein the half wall extends through the vertically aligned opening such that the generally vertical terminal end is disposed vertically within the cavity.

7. The newel system of claim 6, further comprising a base having mounted to and adjacent the bottom of the newel, and the base receiving the newel vertically therein and the half wall longitudinally therethrough.

8. The newel system of claim 7, wherein the base comprises:

a base front wall;

a base left wall and a base right wall, each base left and right wall extending rearwardly from the base front wall;

a base cavity defined by the base front wall, the base left wall, and the base right wall, and the terminal end of the half wall disposed in the cavity; and a base back opening defined by and extending from the top to the bottom of the base left and base right walls and in communication with the base cavity, said half wall extending through the base back opening.

9. The newel system of claim 6, further comprising molding mounted adjacent the bottom of the newel, and the molding defining a molding opening and the half wall extending through the molding opening.

10. The newel system of claim 9, wherein the molding comprises:

a molding front segment;

a molding left segment and a molding right segment, each molding left and right segment extending rearwardly from the molding front segment; and a molding back segment defined by and extending from the top to the bottom of the molding left and molding right segment.

11. The newel of claim 6, wherein the top wall is angled similar to the rake defined by the set of stairs.

12. The adjustable newel system of claim 6, further comprising:

a rear segment spaced apart from and at equal height with the front wall and extending between the left and right walls and above the rear opening, wherein the rear segment extends downward a length less than the left and right walls, and wherein the rear segment is above the top wall at the opening.

13. The adjustable newel system of claim 6, further comprising:

a cap disposed above the front wall;

wherein the cap is above the top wall at the rear opening; and wherein the top wall angles upwardly and rearwardly from the rear opening such that some portions of the top wall are at a vertical height higher than the cap.

14. A newel system comprising:

a front wall on a newal;

left and right walls spaced apart and parallel, the left and right walls extending rearwardly from the front wall;

a rear segment spaced apart from and at equal height with the front wall and extending between the left and right walls, wherein the rear segment extends downward a length less than the left and right walls; and a cavity defined by the inner surfaces of the front wall, left wall, right wall, and rear segment respectively; and, a rear opening defined by a rear edge on each of the left and right walls and defined by a bottom edge of the rear segment, the rear opening in communication with the cavity;

wherein the rear segment is above a top wall on a half wall in a staircase system including a set of stairs at the rear opening.

15. The newel system of claim 14, further comprising:

a rake on the staircase defined by a rise and run of stairs on the staircase, wherein the top wall is angled similarly to the rake.

16. A method of installing a three-sided newel to simulate a four-sided newel attached to a half wall, the method comprising the steps of:

providing a staircase including a set of stairs having a rake defined by a rise and run of each stair and a half wall on the staircase including a top wall and a generally vertical terminal end;

providing a three-sided newel defining a rear opening extending from adjacent the top of the newel to the bottom of the newel and defining an inner cavity in communication with the opening; and inserting the terminal end of the half wall through the opening such that the terminal end is disposed within the cavity.

17. The method of claim 16, further comprising the steps of:

adjusting the three-sided newel longitudinally from front to back; and securing the three-sided newel to the half wall.

18. The method of claim 16, further comprising the steps of:

adjusting the three-sided newel vertically up and down; and securing the three-sided newel to the half wall.

19. The method of claim 16, wherein subsequent to the step of providing a stair case comprises the steps of:

ensuring the angle of the top wall relative to the floor is equal to the rake of the stairs.

20. The method of claim 16, wherein the top wall is angled similarly to the rake, further comprising the steps of:

contacting the angled top wall with a rear segment of the newel above the rear opening, wherein the angled top wall extends rearwardly and upwardly from its contact with the rear segment.

* * * * *

UNITED STATES PATENT AND TRADEMARK OFFICE

CERTIFICATE OF CORRECTION

PATENT NO. : 8,973,314 B1
APPLICATION NO. : 14/059886
DATED : March 10, 2015
INVENTOR(S) : Craig Allen Kurtz It is certified that error appears in the above-identified patent and that said Letters Patent is hereby corrected as shown below:

In the Claims

Column 8, line 5 (Claim 14) change "on a newal" to --on a newel--

Signed and Sealed this
Twenty-third Day of June, 2015

Michelle K. Lee

Michelle K. Lee
*Director of the United States Patent and Trademark Office*